US005211305A

United States Patent [19]

Horton

[11] Patent Number: 5,211,305

[45] Date of Patent: May 18, 1993

[54] CARTON

[75] Inventor: Edward A. Horton, Middletown, Ohio

[73] Assignee: American Packaging Corporation, Philadelphia, Pa.

[21] Appl. No.: 919,894

[22] Filed: Jul. 27, 1992

[51] Int. Cl.[5] ..... B65D 43/16; B65D 5/56

[52] U.S. Cl. ..... 220/461; 220/403; 220/404; 229/125.09; 229/125.17; 229/125.26

[58] Field of Search ..... 220/403, 408, 410, 461, 220/462, 404; 229/123.2, 123.3, 125.09, 125.11, 125.13, 125.14, 125.17, 125.25, 125.26, 125.27, 125.32, 125.18

[56] References Cited

U.S. PATENT DOCUMENTS

| | | | |
|---|---|---|---|
| 1,767,742 | 6/1930 | Case | 229/125.11 |
| 2,030,134 | 2/1936 | Burgener | 229/125.14 |
| 2,282,150 | 5/1942 | Andary | 229/125 |
| 2,564,252 | 8/1951 | Dickson, Jr. | 229/125.14 |
| 2,786,612 | 3/1957 | Gallo | 229/125.18 |
| 2,805,812 | 9/1957 | Seaton | 229/125.14 |
| 3,110,436 | 11/1963 | Wagner | 229/125.26 |
| 3,298,590 | 1/1967 | Gray | 229/125.14 |
| 3,834,570 | 9/1974 | Barr | 220/403 |
| 4,042,169 | 8/1977 | Burgdorf | 229/125.17 |
| 4,047,660 | 9/1977 | Bell et al. | 229/125.17 |
| 4,267,928 | 5/1981 | Curry, Jr. | 220/403 |
| 4,491,252 | 1/1985 | Schmidt et al. | 229/125.14 |
| 5,083,701 | 1/1992 | Passamoni | 229/125.17 |

*Primary Examiner*—Gary E. Elkins
*Attorney, Agent, or Firm*—Frank A. Follmer

[57] ABSTRACT

A carton-type container has a lid which is snapped into place on top of a paperboard outer shell having a sift-proof inner liner. The lid is provided with a re-closable pour opening through which the product contained within the container can be repeatedly dispensed therefrom.

14 Claims, 3 Drawing Sheets

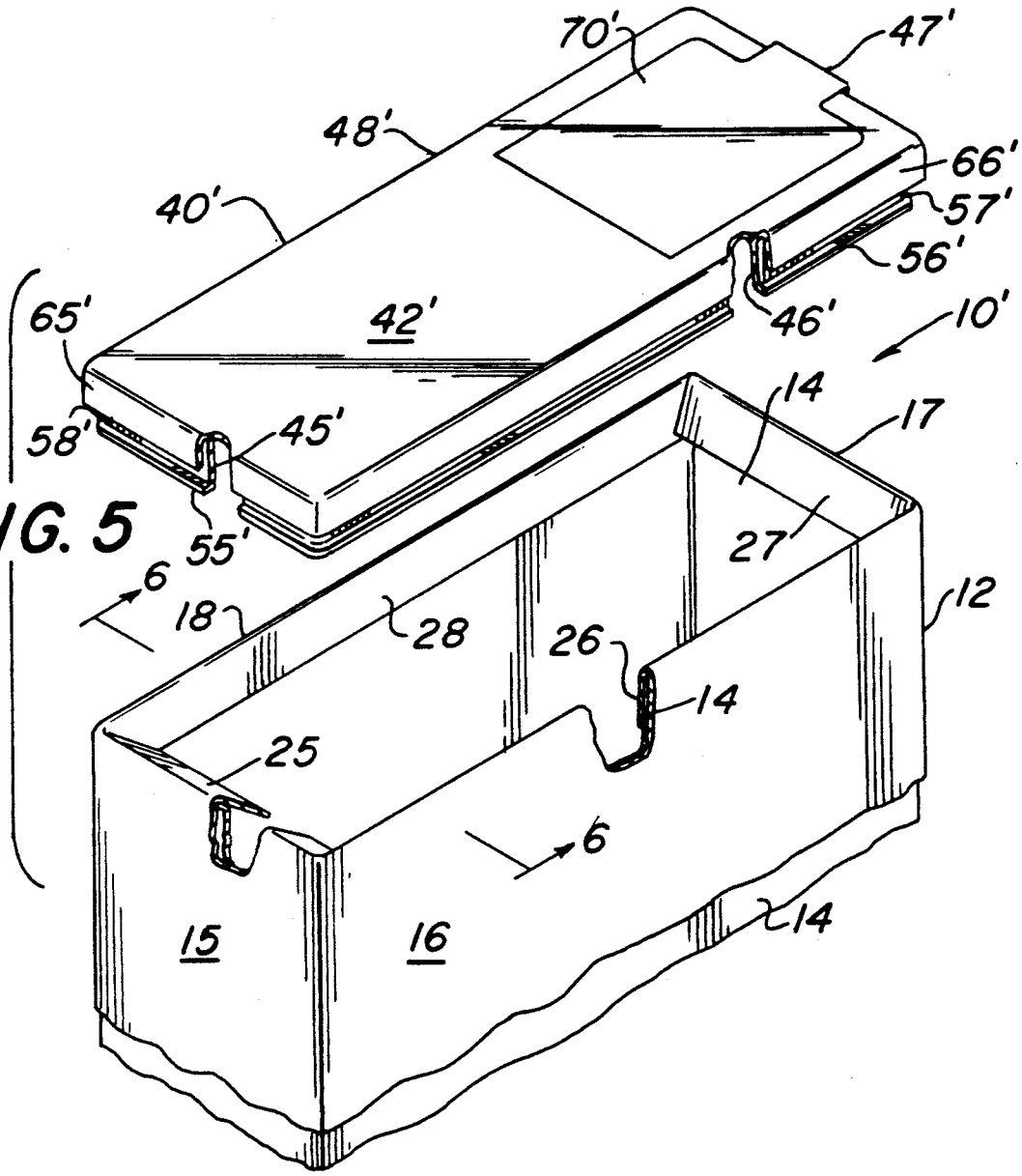
FIG. 5
FIG. 6
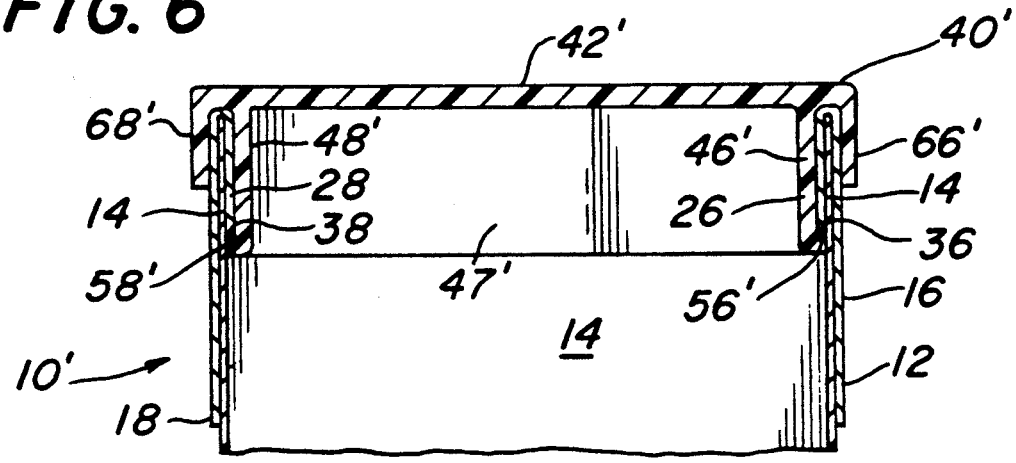

CARTON

BACKGROUND OF THE INVENTION

1. Field of the Invention

This invention relates to the field of carton-type containers and more particularly to cartons of the type comprising an outer shell made of paperboard and a sift-proof inner liner made of a plastic material.

2. Description of the Prior Art

Cartons of the indicated type having an outer shell of paperboard and an inner liner of a plastic material are well known, cartons of this type being described in U.S. Pat. Nos. 2,099,257, 2,166,389, 4,032,060, 4,099,665, 4,236,368, and 4,838,424.

While these prior art cartons are satisfactory in many applications, they are not entirely suitable in applications where the carton is opened by breaking open the top of the outer shell and the inner liner thereof and it is necessary to re-close the top of the carton after use. Difficulties are encountered in achieving a complete closure of the liner particularly in applications where the liner is opened and re-closed during repeated use of the carton to dispense its contents.

SUMMARY OF THE INVENTION

It is the general object of the invention to provide a carton of the type having a paperboard outer shell and a sift-proof inner liner which can be repeatedly opened and closed for the dispensing of the contents thereof.

Another object of the invention is to provide a carton of the indicated type which is environmentally friendly in that the various parts thereof, which are made of different materials, can be separated from one another easily for the effective and separate disposal thereof.

Briefly stated, the above and other objects of the invention are achieved by the provision of a carton having a box-like configuration and comprised of an outer shell made of a paperboard material, a liner contained within the outer carton and made of a sift-proof material, and a lid made of a recyclable plastic material. The outer shell comprises four sidewalls arranged in a rectangular configuration and is provided with means at the lower end thereof for forming a rectangular bottom closure. The outer shell has a rectangular-shaped open top formed at the upper ends of the sidewalls thereof, said sidewalls having flaps bent downwardly from the upper end thereof to provide a shoulder-like rim extending around the top end of the outer carton at a location spaced downwardly from said top end. The lid has a top wall and four sidewalls extending downwardly from the top wall to overlie said flaps of the sidewalls of the outer carton. The sidewalls of the lid are provided with shoulders constructed and arranged to interlock with the shoulder-like rim provided by the flaps of the outer shell to secure the lid in position on top of the outer shell.

BRIEF DESCRIPTION OF THE DRAWINGS

FIG. 5 is a perspective view showing a second embodiment of the carton in accordance with the invention.

FIG. 6 is a sectional view taken generally on line 6—6 of FIG. 5.

DETAILED DESCRIPTION OF THE PREFERRED EMBODIMENTS

Figure 1:
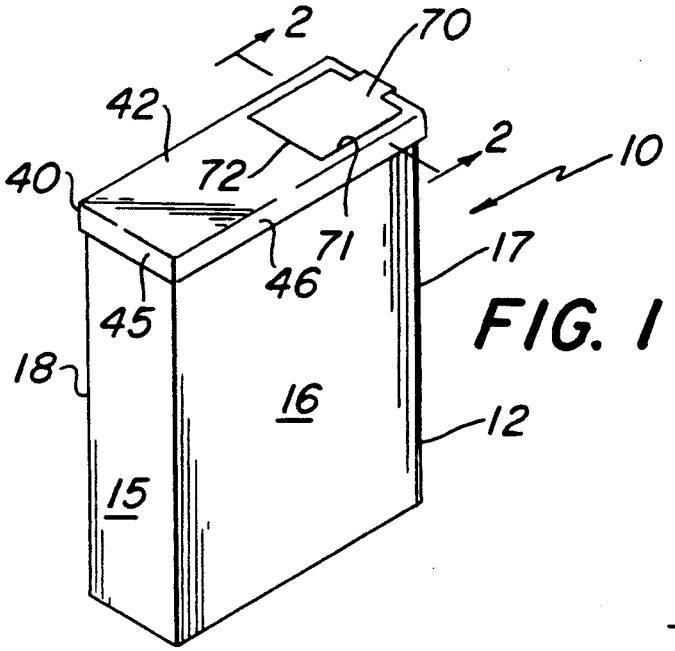
FIG. 1 is a perspective view of a carton in accordance with the invention.

The carton-type of container in accordance with the invention is indicated generally at 10 in FIG. 1 and comprises an outer shell 12 and an inner liner 14. The outer shell 12 is constructed from a carton blank as described in said prior patents and is made of a suitable paperboard or boxboard material. Outer shell 12 has four sidewalls 15, 16, 17, 18 provided with flaps formed at the lower ends thereof, which flaps are folded over for forming a rectangular bottom closure 20 of the carton in a conventional manner as is described in said prior-mentioned. patents.

Sidewalls 15, 16, 17, and 18 are also provided with flaps 25, 26, 27, and 28, respectively, formed at the upper ends thereof. Flaps 25, 26, 27, and 28 are folded outwardly and downwardly from the upper ends of sidewalls 15, 16, 17, and 18, respectively, to form a rectangular-shaped open top of outer shell 12 and to extend alongside the outer sides of sidewalls 15, 16, 17, and 18 to provide a shoulder-like rim extending around the outside of outer shell 12 at a location spaced downwardly from said open top thereof. The shoulder-like rim is comprised of the lower edges 35, 36, 37, and 38, of flaps 25, 26, 27, and 28, respectively.

Liner 14 is sift-proof and is made of a suitable moisture/vapor-proof material, such as for example, a material comprised of layers, arranged from the outside of the liner to the inside thereof, of 30# paper / 5# low density polyethelene / 0.0003 inch thick foil / 22# low density polyethelene. Liner 14 has a tubular construction that is closed at its lower end by a transverse seal and folded at its bottom 21 to rest on the bottom closure 20 as is described in said prior patents. The top end of liner 14 is open and is adhered to the inner surfaces of sidewalls 15, 16, 17, and 18 by a suitable adhesive along a band 22 extending around the perimeter of liner 14 at the upper end thereof as shown in FIGS. 2 and 3.

Container 10 also comprises a rectangular-shaped lid 40 made of a recyclable plastic material, such as a low density polyethylene. Lid 40 is constructed and arranged to snap into place at the top end of outer shell 12, as will be described hereafter. Lid 40 comprises a rectangular top wall 42 and four sidewalls 45, 46, 47, and 48 arranged in a rectangular configuration to extend downwardly from wall 42 to overlie flaps 25, 26, 27, and 28, respectively, of outer shell 12. Sidewalls 45, 46, 47, and 48 have shoulders 55, 56, 57, and 58, respectively, formed at their lower ends and adapted to interlock with the shoulder-like rim formed by flaps 25, 26, 27, and 28 of outer shell 12 to secure lid 40 in position on top of outer shell 12. Lid 40 has four interior walls 65, 66, 67, and 68 arranged in a rectangular configuration extending downwardly from top wall 42 to be in spaced apart parallel relation to sidewalls 45, 46, 47, and 48, respectively. Sidewalls 45–48 and interior walls 65–68 are constructed and arranged to define a channel-like opening adapted to receive flaps 25.28 of outer shell 12 as well as the upper portions of both the upper ends of the liner 14 and the outer shell 12 in an arrangement whereby lid 40 can be snapped onto the upper ends of outer shell 12 and liner 14.

Top wall 42 of lid 40 is provided with a re-closable pour opening means of a type well known in the art. The re-closable pour opening means shown in FIGS. 1 to 3 comprises a rectangular-shaped flap 70 which cooperates with a pour opening 71 of the same shape. Flap 70 is hinged at one end along a hinge 72 formed by a reduced thickness of the top wall 42 and is adapted to snap into position along a pointed edge 73 which cooperates with a corresponding engagable edge 43 on the top wall 42 in an arrangement as best shown in FIG. 3. In FIG. 3, the closed position of the pour opening means is shown in solid lines and the a partially opened position thereof is shown in dashed lines. It will be apparent from this figure that the pour opening 71 can be opened and closed repeatedly by movement of flap 70 between open and closed positions to permit the dispensing of the contents of the container 10. Re-closable pour opening means of this type are well known in the art and three additional such pour opening means are illustrated in FIG. 4. It will be apparent that various types of re-closable pour openings means can be employed in the container 10 in accordance with the invention.

Figure 2:
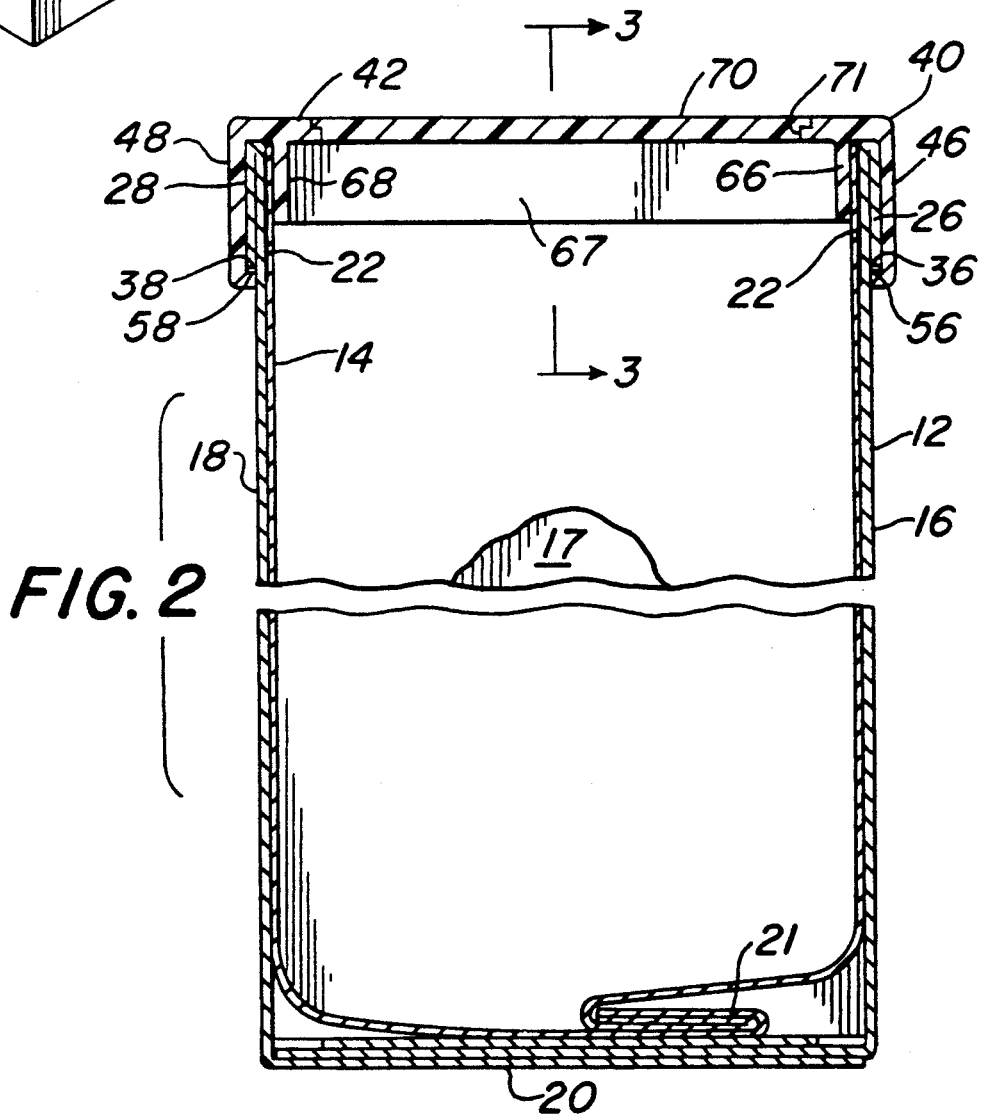
FIG. 2 is a sectional view taken generally on line 2—2 of FIG. 1.
Figure 3:
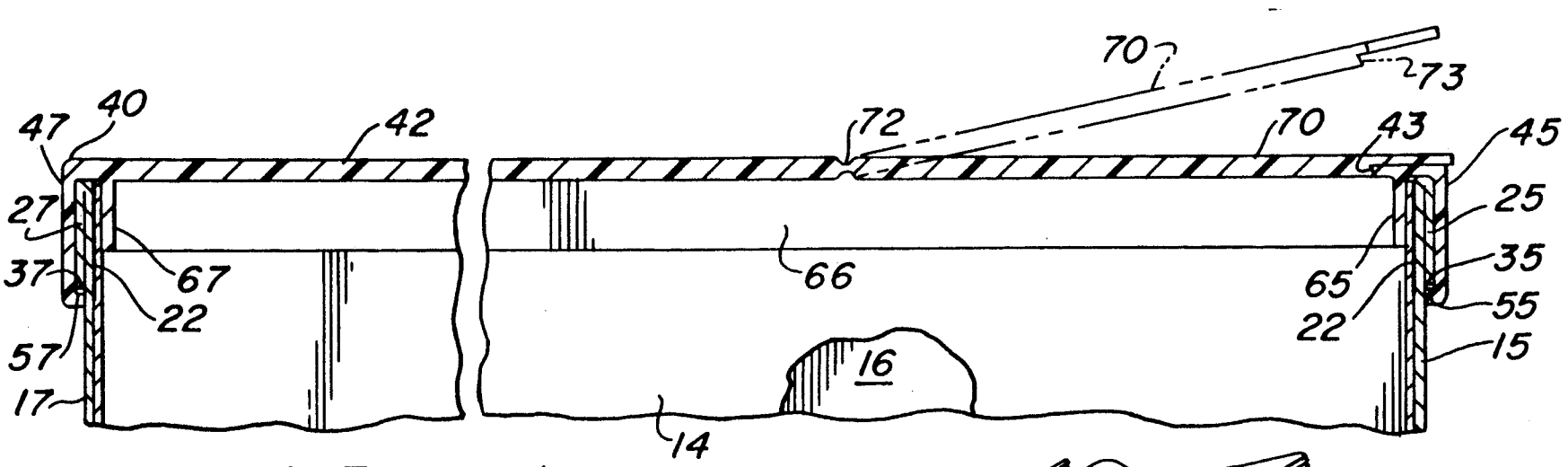
FIG. 3 is a fragmentary sectional view taken generally on line 3—3 of FIG. 2.
Figure 4:
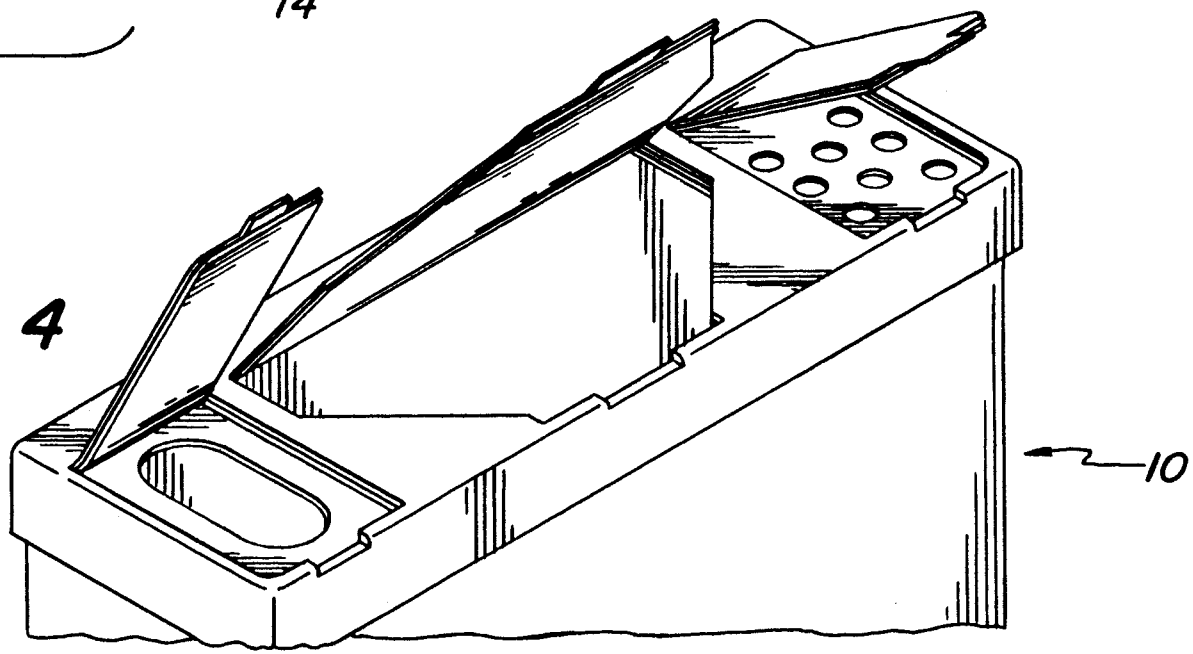
FIG. 4 is a fragmentary perspective view showing various types of pour openings in the lid for use in dispensing the contents of the carton.

The container 10' shown in FIGS. 5 and 6 is essentially the same as the container 10 shown in FIGS. 1 to 3 wherefore the corresponding parts have been given the same reference numerals except where such a part is modified, in which case the corresponding part is given the same reference numeral with a prime (') added. Thus, container 10' comprises an outer shell 12, an inner liner 14, and a lid 40'. The main difference between containers 10 and 10' is that container 10' has the flaps 25–28 of outer shell 12 folded inwardly and downwardly from the upper ends of sidewalls 15–18 to form a rectangular-shaped open top of outer shell 12 and to extend alongside the inner side of sidewalls 15–18 with the upper end of liner 14 being positioned between flaps 25–28 and the opposed upper portions of the sidewalls 15–28 as is best shown in FIG. 6. By this arrangement, flaps 25–28 provide a shoulder-like rim extending around the inside of outer shell 12 at a location spaced downwardly from its open top, said shoulder-like rim being comprised of lower edges 35–38 of flaps 25–28, respectively.

Lid 40' is constructed and arranged to snap into place at the top end of outer shell 12 and comprises a rectangular top wall 42' and four sidewalls 45'–48' arranged in a rectangular configuration to extend downwardly from wall 42' to overlie inwardly folded flaps 25–28, respectively. Sidewalls 45'–48' have shoulders 55'–58', respectively, formed at their lower end and adapted to interlock with the shoulder-like rim formed by flaps 25–28 of the outer shell 12 to secure lid 40' in position on top of outer shell 12. Lid 40' has four exterior walls 65'–68' arranged in a rectangular configuration extending downwardly from the top wall 42' to be in spaced apart parallel relation to sidewalls 45'–48', respectively. Sidewalls 45'–48' and exterior walls 65'–68' are constructed and arranged to define a channel-like opening adapted to receive flaps 25–28 of outer shell 12 as well as the upper portions of both the upper ends of liner 14 and the outer shell 12 in an arrangement whereby lid 40' can be snapped onto the upper ends of outer shell 12 and liner 14 to the position as shown in FIG. 6.

Top wall 42' of lid 40' is provided with a re-closable pour opening means 70' of the same construction as the pour opening means 70 of container 10.

By reason of the construction, of container 10' whereby the flaps 25–28 are folded inwardly and downwardly so that the upper end of liner 14 is positioned between said flaps 25–28 and the opposed upper portions of said sidewalls 15–18 of the outer shell 12, it is not necessary in many application to adhere the upper portion of liner 14 to the outer shell 12. Instead, the parts are constructed and arranged so that when lid 40' is snapped into position, as shown in FIG. 6, the sidewalls 45'–48' and 65'–68' are arranged to compress the liner 14 therebetween the inwardly folded flaps 25–28 and the opposed upper portions of the sidewalls 15–18. Thus, the manufacturer of container 10' is somewhat more simpler than the manufacturer of container 10.

It will be apparent that the containers 10 and 10' are environmentally friendly in that the three parts of each container, namely the outer shell 12, the inner liner 14, and the lid 40 of container 10, and the corresponding three parts of container 10', which parts are all made of different materials, can be separated from one another easily for the effective and separate disposal thereof. In the case of container 10, the lid 42 is removed by pulling it away from the snaped together position thereof, after which the liner 14 and outer shell 12 can be easily separated since the only connection therebetween is the adhesive band 22. Likewise, in the case of container 10', once the lid 40' is removed from its snapped onto position, the liner 14 can be easily separated from outer shell 12 for the separate disposal of all three parts.

What is claimed is:

1. A carton having a six-sided configuration comprising an outer shell made of paperboard material, a liner within said outer shell made of a sift-proof material and having an open upper end, said outer shell having an upper and a lower end and including four sidewalls extending therebetween and arranged in a rectangular configuration, said outer shell having means at the lower end thereof for forming a rectangular bottom closure, said outer shell having a rectangular-shaped open top formed at the upper ends of said sidewalls, said sidewalls of said outer shell having flaps folded downwardly from said open top thereof to extend alongside said sidewalls to provide a rim extending around said outer shell at a location spaced downwardly from said top end, a rectangular lid made of a recyclable plastic material, said lid having a top wall provided with a re-closable pour opening therein and four sidewalls arranged in a rectangular configuration and extending downwardly from said top wall to overlie said flaps of said sidewalls of said outer shell, said sidewalls of said lid having shoulders formed thereon adapted to interlock with said rim formed by said flaps of the outer shell to secure said lid in position on top of said outer shell, and means for adhering the inner wall of said outer shell to the upper end of said liner along a band extending around a perimeter of said liner at its upper end.

2. A carton according to claim 1 wherein said flaps of said outer shell are folded outwardly to extend alongside said sidewalls of said outer shell.

3. A carton according to claim 2 wherein said sidewalls of said lid are arranged to enclose said sidewalls of said outer shell with said shoulders of said lid projecting inwardly to interlock with said rim of said outer shell.

4. A carton according to claim 3 wherein said lid has four interior walls arranged in a rectangular configuration extending downwardly from said top wall thereof in spaced apart parallel relation to said sidewalls of said lid.

5. A carton according to claim 4 wherein said sidewalls and said interior walls of said lid define a channel-shaped opening adapted to receive said flaps and upper portions of said upper ends of said inner liner and said outer shell in an arrangement whereby said lid can be snapped onto said upper ends of said outer shell and inner liner.

6. A carton having a box shape comprising an outer shell made of paperboard material, a liner within said outer shell made of a sift-proof material, said liner having an upper portion providing a rectangular-shaped open top portion having a top edge, said outer shell having an upper and a lower end and including four sidewalls extending therebetween, said outer shell having means at the lower end thereof for forming a rectangular bottom closure, said outer shell having a rectangular-shaped open top end formed at the upper ends of said sidewalls, said sidewalls of said outer shell having flaps folded downwardly from said top end thereof to extend alongside said sidewalls to provide a rim extending around said outer shell at a location spaced downwardly from said top end, a rectangular lid made of a recyclable plastic material, said lid having a top wall provided with a re-closable pour opening therein and four sidewalls arranged in a rectangular configuration and extending downwardly from said top wall to overlie said flaps of said sidewalls of said outer shell, said sidewalls of said lid having shoulders formed thereon adapted to interlock with said rim formed by said flaps of the outer shell to secure said lid in position on top of said outer shell, and means for securing said upper portion of said liner in a fixed position adjacent said top end of said outer shell with said top edge thereof contained within said outer shell.

7. A carton according to claim 6 wherein said flaps of said outer shell are folded outwardly to extend along the side of said sidewalls of said outer shell, said sidewalls of said lid being arranged to enclose said sidewalls of said outer shell with said shoulders of said lid projecting inwardly to interlock with said rim of said outer shell.

8. A carton according to claim 7 wherein said lid has four interior walls arranged in a rectangular configuration extending downwardly from said top wall thereof in spaced apart parallel relation to said sidewalls of said lid.

9. A carton according to claim 8 wherein said sidewalls and said interior walls of said lid define a channel adapted to receive said top end of said outer shell, said flaps at the top end of said outer shell, and the said upper portion of said liner, said top edge of said liner being received in said channel.

10. A carton according to claim 6 wherein said liner securing means comprises means for adhering the inner wall of said outer shell to said upper portion of said liner along a band extending around a perimeter of said upper portion of said liner.

11. A carton according to claim 6 wherein said flaps of said outer shell are folded inwardly to extend along the inner side of said sidewalls of said outer shell with said upper portion of said liner being positioned between said flaps and said sidewalls of said outer shell.

12. A carton according to claim 11 wherein said sidewalls of said lid enclose said flaps of said outer shell with said shoulders of said lid projecting outwardly to interlock with said rim of said outer shell.

13. A carton according to claim 12 wherein said lid has four exterior walls arranged in a rectangular configuration extending downwardly from said top wall of said lid in spaced apart parallel relation to said sidewalls of said lid.

14. A carton according to claim 13 wherein said sidewalls of said lid and said exterior walls of said lid define a channel adapted to receive said top end of said outer shell, said flaps at the top end of said outer shell, and said upper portion of said liner with said top edge of said liner being received in said channel.

* * * * *